US006231169B1

(12) United States Patent
Yazaki et al.

(10) Patent No.: US 6,231,169 B1
(45) **Date of Patent: *May 15, 2001**

(54) INK JET PRINTING HEAD INCLUDING A BACKING MEMBER FOR REDUCING DISPLACEMENT OF PARTITIONS BETWEEN PRESSURE GENERATING CHAMBERS

(75) Inventors: Shiro Yazaki; Shinri Sakai, both of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/069,992

(22) Filed: Apr. 30, 1998

(30) Foreign Application Priority Data

Apr. 30, 1997 (JP) ..... 9-126419
Feb. 12, 1998 (JP) ..... 10-029415

(51) Int. Cl.[7] ..... B41J 2/045

(52) U.S. Cl. ..... 347/70

(58) Field of Search ..... 347/68–71

(56) References Cited

U.S. PATENT DOCUMENTS 5,185,689 2/1993 Maniar ..... 361/313
5,670,999 * 9/1997 Takeuchi et al. ..... 347/71 X

FOREIGN PATENT DOCUMENTS 0 600 382 6/1994 (EP) ..... B41J/2/16
0 738 599 10/1996 (EP) ..... B41J/2/045
0 820 869 1/1998 (EP) ..... B41J/2/045
3297653 * 12/1991 (JP) ..... 347/71

OTHER PUBLICATIONS

Patent Abstracts of Japan, vol. 096, No. 010, Oct. 31, 1996 & JP 08 156272 A (Ricoh Co Ltd), Jun. 18, 1996 *Abstract.

K. W. Kwon et al. "Degradation–Free Ta2O5 Capacitor after BPSG Reflow at 850 degree celsius for High Density DRAMs" pp. 351–354.

* cited by examiner

*Primary Examiner*—Benjamin R. Fuller
*Assistant Examiner*—C Dickens
(74) *Attorney, Agent, or Firm*—Sughrue, Mion, Zinn, Macpeak & Seas, PLLC

(57) ABSTRACT

An ink jet recording head includes at least a row of nozzle aperture; a passage formed substrate having partitions forming at least a row of pressure generating chambers, each communicating the respective nozzle aperture; a diaphragm forming a part of the pressure generating chambers and at least an upper surface of which serves as a lower electrode; a piezoelectric vibrator including, a piezoelectric active part having a piezoelectric layer formed on the surface of the diaphragm, and an upper electrode formed on the surface of said piezoelectric layer and formed in an area opposite to said pressure generating chamber; and a backing member joined to the side of the piezoelectric layer and having partitioning walls forming a concave portion being space to extent that a movement of the piezoelectric active part is not prevented, and fixed to the passage formed substrate such that each partitioning wall is opposite to the partition of the passage formed substrate.

16 Claims, 9 Drawing Sheets

INK JET PRINTING HEAD INCLUDING A BACKING MEMBER FOR REDUCING DISPLACEMENT OF PARTITIONS BETWEEN PRESSURE GENERATING CHAMBERS

BACKGROUND OF INVENTION

The present invention relates to an ink jet recording head for expanding or contracting a part of a pressure generating chamber communicating with a nozzle aperture by an actuator for flexural oscillation so as to jet an ink droplet from the nozzle aperture.

An ink jet recording head has two types: a piezoelectric vibration type for mechanically deforming a pressure generating chamber and pressurizing ink; and a bubble jet type provided with a heater element in a pressure generating chamber for pressurizing ink by the pressure of bubbles generated because of the heat of the heater element. The piezoelectric vibration type of recording head is further classified into two types of a first recording head using a piezoelectric vibrator displaced in an axial direction; and a second recording head using a piezoelectric vibrator displaced by flexure. As for the first recording head, although high-speed driving is enabled and recording in high density is enabled, there is a problem that the number of manufacturing processes is many because cutting is required for machining a piezoelectric vibrator and three-dimensional assembly is required when a piezoelectric vibrator is fixed to a pressure generating chamber.

In the meantime, because for the second recording head, as a silicon monocrystalline substrate is used for base material, a passage such as a pressure generating chamber and a reservoir is formed by anisotropic etching, an elastic film can be made extremely thin, the pressure generating chamber and a piezoelectric vibrator can be formed very precisely respectively by a technique for forming the piezoelectric vibrator using film forming technique such as sputtering piezoelectric material, the opening area of the pressure generating chamber can be reduced as much as possible and recording density can be enhanced.

However, to enhance recording density, a wall for partitioning pressure generating chambers is required to be made thin, as a result, the rigidity of the wall for partitioning pressure generating chambers is deteriorated and there occur problems of crosstalk, the failure of jetting an ink droplet and others.

SUMMARY OF INVENTION

The present invention is made to solve such problems and the object is to provide an ink jet recording head in which the rigidity of a partition for partitioning pressure generating chambers of a passage formed substrate can be enhanced without thickening the partition for partitioning pressure generating chambers.

According to the first aspect of the invention, there is provided an ink jet recording head comprising: a nozzle;

- a passage formed substrate having partitions forming at least a row of pressure generating chambers, which is communicated with said nozzle;
- an elastic film forming a part of the pressure generating chambers;
- a piezoelectric vibrator formed on a diaphragm opposite to said pressure generating chamber; and
- a backing member joined to the side of the piezoelectric vibrator and having partitioning walls forming a concave portion being spaced to extent that a movement of the piezoelectric vibrator is not prevented, and fixed to the passage formed substrate such that each partitioning wall is opposite to the partition of the passage formed substrate.

In the first aspect, the displacement of the piezoelectric active part is received by the backing member fixed to the passage formed substrate and the partition of the passage formed substrate is prevented from being bent.

According to the second aspect of the invention, there is provided the ink jet recording head according to the first aspect, wherein whole faces of the partitioning walls opposite to the passage formed substrate are joined to the passage formed substrate.

In the second aspect, the backing member is securely fixed to the passage formed substrate and crosstalk is securely prevented.

According to the third aspect of the invention, there is provided the ink jet recording head according to the second aspect, wherein the elastic film and an lower electrode of said piezoelectric vibrator are formed in a part joined to the partitioning walls with the passage formed substrate.

In the third aspect, the backing member and the passage formed substrate are joined via the diaphragm and crosstalk is securely prevented.

According to the fourth aspect of the invention, there is provided the ink jet recording head according to the second aspect, wherein: only the elastic film is formed in a part joined to the partitioning walls with the passage formed substrate.

In the fourth aspect, the backing member and the passage formed substrate are joined via only the elastic film and crosstalk is securely prevented.

According to the fifth aspect of the invention, there is provided the ink jet recording head according to any one of the first to fourth aspects, wherein the partitioning wall has a communicating part which communicates with adjacent the concave portion.

In the fifth aspect, as the concave portions are connected via the communicating part, the variation of pressure in each concave portion is relaxed.

According to the sixth aspect of the invention, there is provided the ink jet recording head according to the fifth aspect, wherein the communicating part is not opposite to the face of the partitioning walls opposite to the passage formed substrate.

In the sixth aspect, the face opposite to the passage formed substrate of the partitioning wall is never reduced by the communicating part and crosstalk is securely prevented.

According to the seventh aspect of the invention, there is provided the ink jet recording head according to any one of the preceding aspects, wherein the width of the concave portion of the backing member is formed such that the width is wider than the width of the pressure generating chamber.

In the seventh aspect, the rigidity of the diaphragm opposite to each pressure generating chamber is not enhanced by the partitioning wall.

According to the eighth aspect of the invention, there is provided the ink jet recording head according to any one of the preceding aspects, wherein dry fluid is sealed in space in the concave portion of the backing member.

In the eighth aspect, the durability of the piezoelectric layer is enhanced.

According to the ninth aspect of the invention, there is provided the ink jet recording head according to any one of preceding aspects, wherein the passage formed substrate and the backing member are made of the same material In the ninth aspect, deformation due to the junction of the backing member is prevented.

According to the tenth aspect of the invention, there is provided the ink jet recording head according to any one of the preceding aspects, wherein: the pressure generating chambers are formed by anisotropically etching a silicon monocrystalline substrate; and each layer of the piezoelectric vibrator is formed by a film forming method and lithography.

In the tenth aspect, a large number of ink jet recording heads provided with nozzle apertures in high density can be relatively easily manufactured.

According to the eleventh aspect of the invention, there is provided the ink jet recording head according to any one of the preceding aspects, wherein: a reservoir which communicates with the pressure generating chamber is formed in the passage formed substrate; and a nozzle plate having nozzle apertures, each communicating with the respective pressure generating chamber, is attached to the passage formed substrate.

In the eleventh aspect, an ink jet recording head for jetting ink from a nozzle aperture can be readily realized.

According to the twelfth aspect of the invention, there is provided the ink jet recording head according to any one of the first to tenth aspects, further comprising: a passage unit attached to the passage formed substrate, the passage unit having a common ink chamber for supplying ink to the pressure generating chambers and a passage respectively connecting the pressure generating chamber and the nozzle aperture.

In the twelfth aspect, ink is jetted from the above nozzle aperture via the passage unit.

DETAILED DESCRIPTION OF THE PREFERRED EMBODIMENTS

The present invention will be described based upon embodiments in detail below.

First Embodiment

Figure 1:
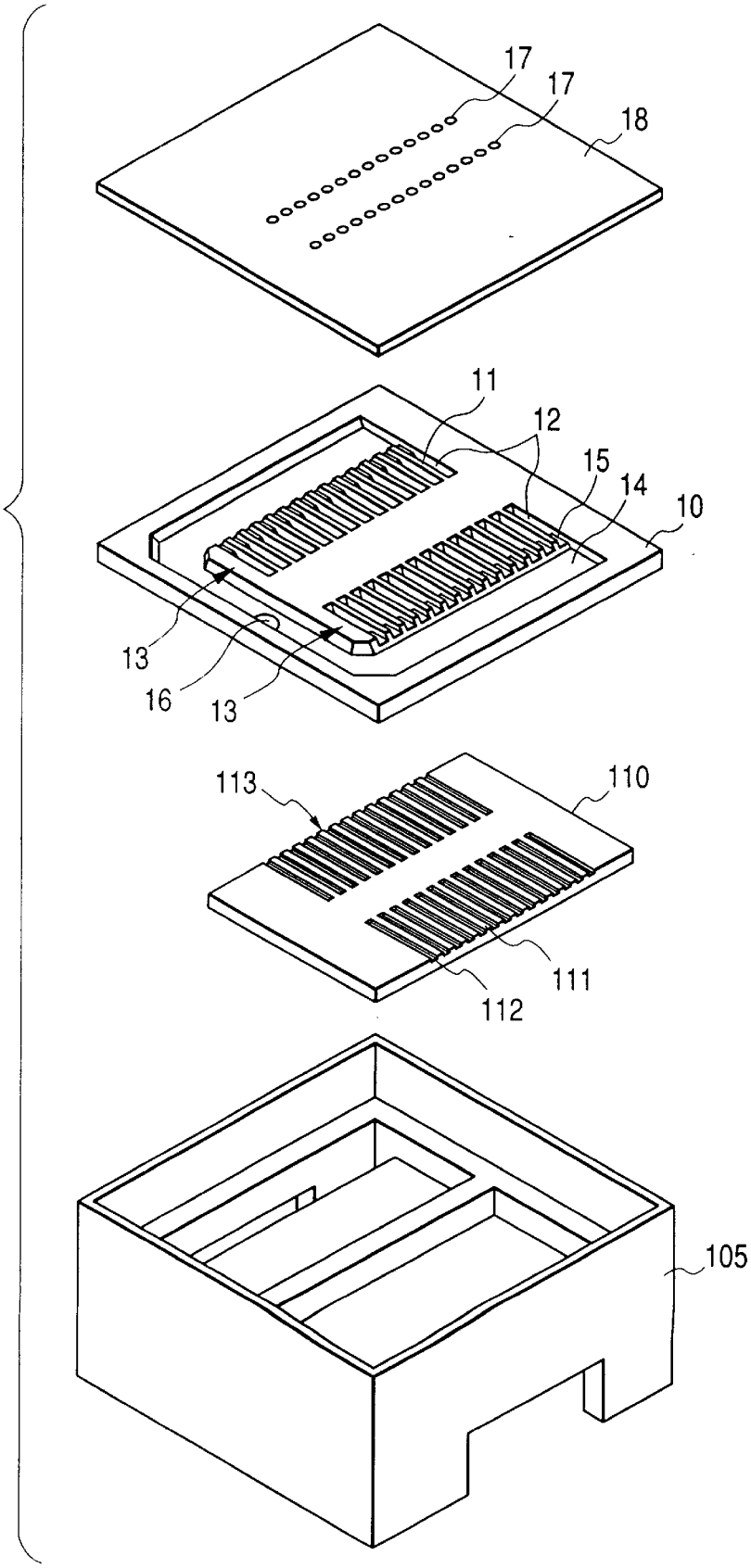
FIG. 1 is an exploded perspective drawing showing an ink jet recording head according to a first embodiment of the present invention.
Figure 2A:
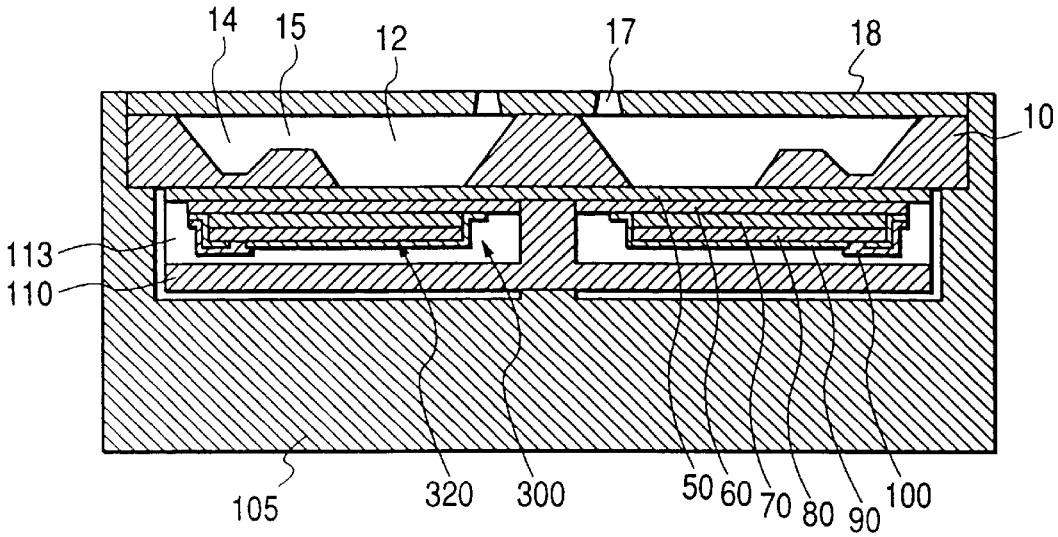
FIGS. 2(*a*) and 2(*b*) respectively show sectional structure of the ink jet recording head according to the first embodiment of the present invention in the longitudinal direction of a pressure generating chamber and in the direction of the array of pressure generating chambers.
Figure 2B:
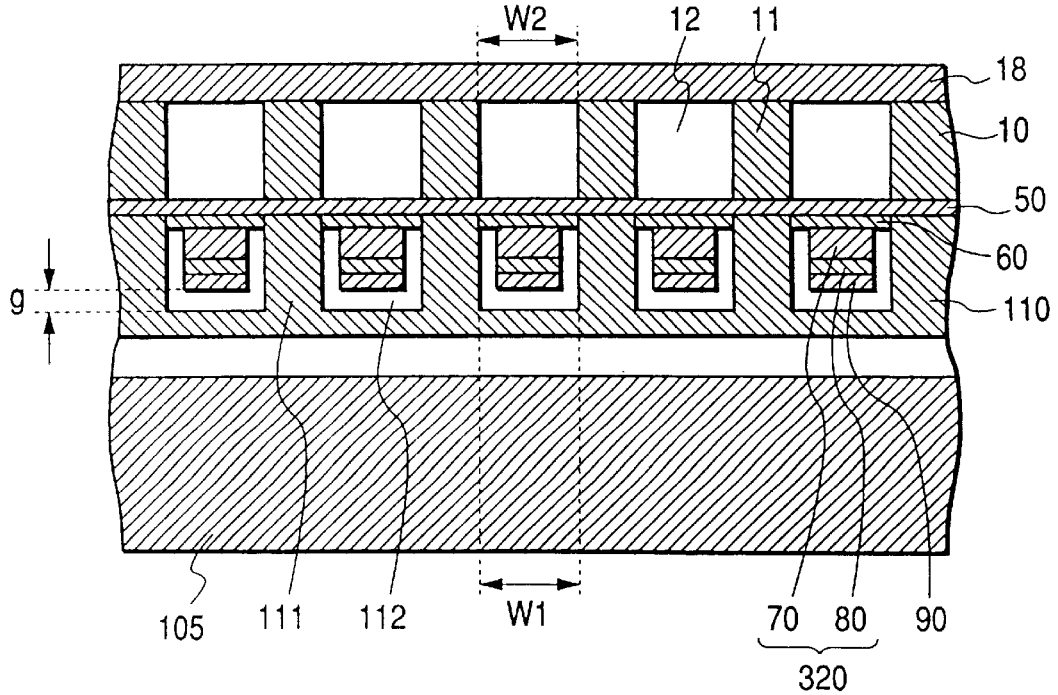
Figure 3A:
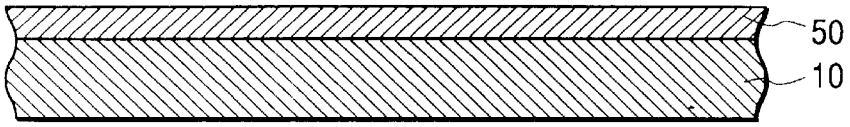
FIGS. 3(*a*) to 3(*e*) show a thin film manufacturing process in the first embodiment of the present invention.
Figure 3B:
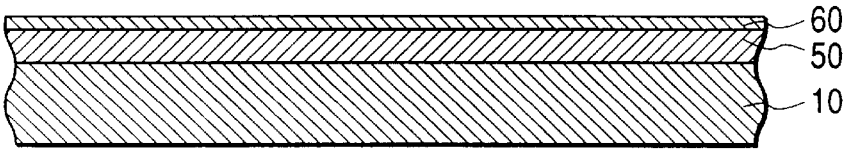
Figure 3C:
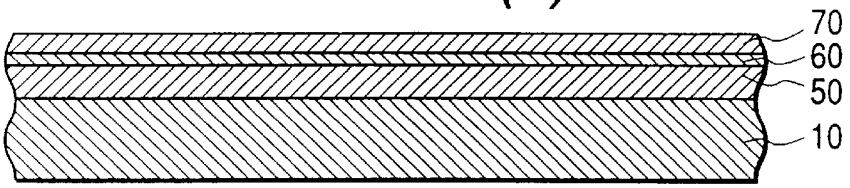
Figure 3D:
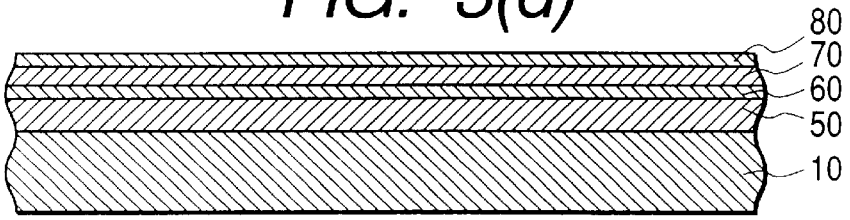
Figure 3E:
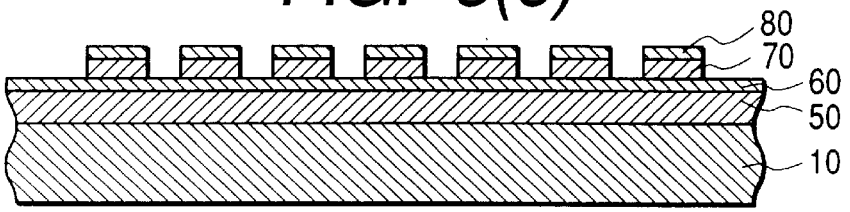

FIG. 1 is an assembly perspective drawing showing an ink jet recording head according to a first embodiment of the present invention and FIGS. 2(*a*) and 2(*b*) show the sectional structure of one pressure generating chamber respectively in the longitudinal direction and in the direction of the width.

As shown in FIGS. 1 to 2(*b*), a passage formed substrate 10 is composed of a silicon monocrystalline substrate with the face orientation of (110) in this embodiment. For the passage formed substrate 10, a passage formed substrate with the thickness of approximately 150 to 300 $\mu$m is normally used, desirably a passage formed substrate with the thickness of approximately 180 to 280 $\mu$m and preferably a passage formed substrate with the thickness of approximately 220 $\mu$m are suitable. This is because array density can be enhanced, keeping the rigidity of a partition between adjacent pressure generating chambers.

One face of the passage formed substrate 10 is an open face and an elastic film 50 with the thickness of 1 to 2 $\mu$m comprising silicon dioxide formed by thermal oxidation beforehand is formed on the other face.

In the meantime, two rows 13 of pressure generating chambers 12 partitioned by plural partitions 11, a reservoir 14 arranged approximately in the shape of a letter U so that three directions of two rows 13 of pressure generating chambers 12 are surrounded by the reservoir and ink supply ports 15 respectively connecting each pressure generating chamber 12 and the reservoir 14 under fixed passage resistance are formed on the side of the open face of the passage formed substrate 10 by anisotropically etching the silicon monocrystalline substrate An ink lead-in port 16 for supplying ink to the reservoir 14 from outside is formed approximately in the center of the reservoir 14.

In the above anisotropic etching, when a silicon monocrystalline substrate is dipped in alkaline solution such as KOH, the silicon monocrystalline substrate is gradually eroded, a first face (111) perpendicular to a face (110) and a second face (111) at an angle of approximately 70° with the first face (111) and at an angle of approximately 35° with the above face (110) appear and the above anisotropic etching is done utilizing a property that the etching rate of the face (111) is approximately 1/180, compared with the etching rate of the face (110). Precise processing can be executed based upon processing in the depth of a parallelogram formed by the two first faces (111) and the diagonal two second faces (111) by such anisotropic etching and the pressure generating chambers 12 can be arrayed in high density.

In this embodiment, the longer side of each pressure generating chamber 12 is formed by the first face (111) and the shorter side is formed by the second face (111). The pressure generating chamber 12 is formed by etching the passage formed substrate 10 up to the elastic film 50. The quantity in which the elastic film 50 is dipped in alkaline solution for etching a silicon monocrystalline substrate is extremely small. Each ink supply port 15 communicating with one end of each pressure generating chamber 12 is formed so that the ink supply port is shallower than the pressure generating chamber 12. That is, the ink supply port 15 is formed by etching halfway in the direction of the thickness of the silicon monocrystalline substrate (half-etching). Half-etching is done by adjusting etching time.

A nozzle plate 18 in which nozzle apertures 17 each of which communicates with the side reverse to the ink supply port 15 of each pressure generating chamber 12 are made is fixed to the side of the open face of the passage formed substrate 10 via an adhesive, a thermically welded film and others. The nozzle plate 18 is composed of glass ceramics or stainless steel and others the thickness of which is 0.1 to 1 mm for example and the coefficient of linear expansion of which is 2.5 to 4.5 [$\times 10^{-6}$/° C.] for example at 300° C. or less. One surface of the nozzle plate 18 covers one face of the passage formed substrate 10 overall and also functions as a reinforcing plate for protecting the silicon monocrystalline substrate from impact and external force.

The size of the pressure generating chamber 12 for applying ink droplet jetting pressure to ink and the size of the nozzle aperture 17 from which ink droplets are jetted are optimized according to the quantity of jetted ink droplets, jetting speed and a jetting frequency. For example, if 360 ink droplets per inch are to be recorded, the nozzle aperture 17 is required to be precisely formed at the groove width of a few tens $\mu$m.

In the meantime, a lower electrode film 60 with the thickness of approximately 0.5 $\mu$m for example, a piezoelectric film 70 with the thickness of approximately 1 $\mu$m for example and an upper electrode film 80 with the thickness of approximately 0.1 $\mu$m for example are laminated on the elastic film 50 on the reverse side to the open face of the passage formed substrate 10 in a process described later and constitutes a piezoelectric vibrator 300 (a piezoelectric element). As described above, the piezoelectric vibrator 300 is constructed by the lower electrode film 60, the piezoelectric film 70 and the upper electrode film 80. In general, a common electrode is selected from the lower electrode 60 or the upper electrode 80 of the piezoelectric vibrator 300, and the other electrode and the piezoelectric film 70 are formed by patterning in each pressure generating chamber 12 in this structure, a piezoelectric active part 320 is constructed by the piezoelectric film 70 and one of the lower electrode 60 and the upper electrode 80 which is formed through the patterning, and is caused to the piezoelectric deformation by applying the voltage the both electrodes.

In this embodiment, the lower electrode film 60 is a common electrode for the piezoelectric vibrator 300 and the upper electrode film 80 is an individual electrode of the piezoelectric vibrator 300, however, they may be also reverse for the convenience of a driving circuit and wiring. In any case, a piezoelectric active part is formed every pressure generating chamber 12. Further, it is possible to commonly use the elastic film 50 and the lower electrode 60 together.

In this embodiment, the piezoelectric active part 320 is defined by the upper electrode 60 and the piezoelectric film 70 formed on a region facing the pressure generating chamber 12 by patterning, and the piezoelectric film 70 and the upper electrode 80 constituted of the piezoelectric active part 320 are continuously formed until a region confronted with the reservoir 14 and the ink supply ports 15. Further, the upper electrode 80 facing the reservoir 14 is connected to a read electrode 100 at a region facing the reservoir 14 though a contact hole 90*a* described later.

Referring to FIGS. 3(*a*) to 4(*c*), a process in which the piezoelectric film 70 and others are formed on the passage formed substrate 10 comprising a silicon monocrystalline substrate will be described below.

As shown in FIG. 3(*a*), first, a wafer of a silicon monocrystalline substrate to be the passage formed substrate 10 is thermally oxidized in a diffusion furnace with the temperature of approximately 1100° C. to form the elastic film 50 comprising silicon dioxide.

Next, as shown in FIG. 3(*b*), the lower electrode film 60 is formed by sputtering. For the material of the lower electrode film 60, platinum (Pt) and others are suitable. This is because the piezoelectric film 70 described later formed by sputtering and a sol-gel transformation method is required to be burned at the temperature of approximately 600 to 1000° C. in the atmosphere or oxygen atmosphere after the film is formed and crystallized. That is, for the material of the lower electrode film 60, conductivity is required to be kept in such a high-temperature and oxygen atmosphere, particularly, if lead zirconate titanate (PZT) is used for the piezoelectric film 70, it is desirable that the change of conductivity by the diffusion of PbO is small and for these reasons, Pt is suitable.

Next, as shown in FIG. 3(*c*), the piezoelectric film 70 is formed. Sputtering may be also used for forming the piezoelectric film 70, however, in this embodiment, so-called sol-gel transformation method in which so-called sol dissolved and dispersed using a metallic organic substance as a solvent is gelled by application and drying and further, the piezoelectric film 70 composed of metallic oxide can be acquired by burning at high temperature is used. For the material of the piezoelectric film 70, PZT is suitable in case PZT is used for an ink jet recording head.

Next, as shown in FIG. 3(*d*), the upper electrode film 80 is formed. The material of the upper electrode film 80 has only to be conductive and many metals such aluminum (Al), gold (Au), nickel (Ni) and platinum (Pt), conductive oxide and others can be used. In this embodiment, a platinum film is formed by sputtering.

Next, as shown in FIG. 3(*e*), the upper electrode film 80 and the piezoelectric film 70 are patterned so that one piezoelectric vibrator is arranged for each pressure generating chamber 12. FIG. 3(*e*) shows a case that the piezoelectric film 70 is patterned using the same pattern as that for the upper electrode film 80, however, as described above, the piezoelectric film 70 is not necessarily required to be patterned. This is because if voltage is applied to the upper electrode film 80 patterned as an individual electrode, an electric filed is applied only between the upper electrode film 80 and the lower electrode film 60 which is a common electrode and has no effect upon the other part. However, in this case, as the application of large voltage is required for obtaining the same excluded volume, it is desirable that the piezoelectric film 70 is also patterned. Afterward, the lower electrode film 60 may be also patterned to remove an unnecessary part, for example the vicinity inside the edge on both sides in the direction of the width of the pressure generating chamber 12. The removal of the lower electrode film 60 is not necessarily required and if the lower electrode film is removed, the whole film is not removed but may be also thinned in the direction of the thickness.

As for patterning, after a resist pattern is formed, patterning is executed by etching and others.

As for a resist pattern, a negative resist is applied by spin and others and a resist pattern is formed by exposure, developing and balding using a mask in a predetermined shape. A positive resist may be also used in place of the negative resist.

Etching is executed using a dry etching device, for example an ion milling device. After etching, a resist pattern is removed using an ashing device and others.

For a dry etching method, a reactive etching method and others may be also used in addition to an ion milling method.

Wet etching may be also used in place or dry etching, however, as patterning precision is a little inferior to that in dry etching and material for the upper electrode film 80 is also limited, it is desirable that dry etching is used.

Figure 4A:
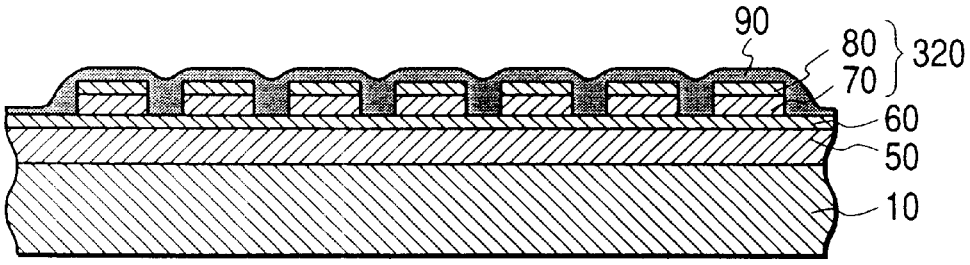
FIGS. 4(*a*) to 4(*c*) show the thin film manufacturing process in the first embodiment of the present invention.
Figure 4B:
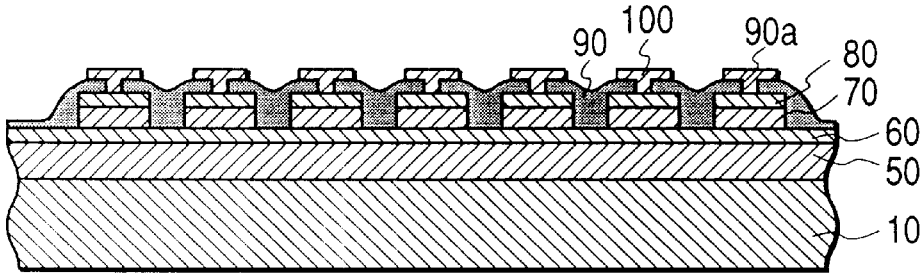
Figure 4C:
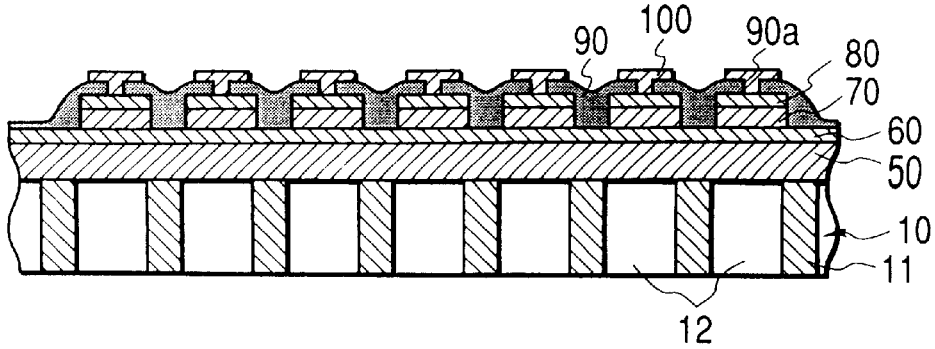

Next, as shown in FIG. 4(*a*), an insulating layer 90 is formed so that it covers the periphery of the upper electrode film 80 and the side of the piezoelectric film 70. For the material of the insulating layer 90, in this embodiment, negative photosensitive polyimide is used.

Next, as shown in FIG. 4(*b*), a contact hole 90*a* is formed in a part opposite to each communicating part 14 by patterning the insulating layer 90. The contact hole 90*a* is provided to connect a lead electrode 100 described later and the upper electrode film 80.

Next, the lead electrode 100 is formed by patterning after an electric conductor such as Cr—Au is formed overall.

The film forming process is as described above. After the films are formed as described above, pressure generating chambers 12 and others are formed by anisotropically etching a silicon monocrystalline substrate using the above alkaline solution as shown in FIG. 4(*c*).

In this embodiment, a backing member 110 is provided on the elastic film 50 on the side of the piezoelectric active part. The backing member 110 is provided with a partitioning wall 111 provided with the same pitch as the partition 11 for partitioning the pressure generating chamber 12 for partitioning a concave portion 112 in which space g to the extent that the upper electrode film 80 is not touched is secured in an area opposite to the pressure generating chamber 12 on the side on which the backing member is joined to the elastic film 50 of the backing member 110. The partitioning wall 111 is fixed to the surface of the elastic film 50 by an adhesive and others opposite to the partition 11 of the passage formed substrate 10. An opening 113 for leading out a cable and others is provided at one end of the concave portion 112.

It is desirable that such a backing member 110 is directly bonded not on the lower electrode film 60 but on the elastic film 50 in view of bonding strength. The piezoelectric film 70 is removed and the backing member may be also bonded to the lower electrode film 60. In any case, the passage formed substrate 10 and the backing member 110 are satisfactorily joined.

The size of each concave portion 112 formed in the partitioning wall 111 of the backing member 110 is not particularly limited if each concave portion 112 has size to the extent that the driving of the piezoelectric active part is not prevented, however, in this embodiment, as the width W1 of each concave portion 112 is selected so that it is wider than the width W2 of each pressure generating chamber 12, the rigidity of the elastic film 50 in an area opposite to the pressure generating chamber 12 is never enhanced.

In the above series of film formation and anisotropic etching, multiple chips are simultaneously formed on one wafer and after the process is finished, the wafer is divided into each passage formed substrate 10 in one chip size shown in FIG. 1. An ink jet recording head is formed by sequentially bonding the divided passage formed substrate 10 to the nozzle plate 18 and the backing member 110. Afterward, the ink jet recording head is fixed in the holder 105, mounted on a carriage and built in an ink jet recording apparatus.

Owing to such constitution, the flexuous deformation of the elastic film 50 is limited to the area of the pressure generating chamber 12, being received by the partition 11 for partitioning the pressure generating chamber 12 for jetting an ink droplet and the partitioning wall 111 of the backing member 110. Hereby, stress which acts upon the pressure generating chamber 12 when an ink droplet is jetted is prevented from being propagated to the partition 11 for partitioning another pressure generating chamber 12 and crosstalk is prevented from being caused.

As described above, for example, when the partition 11 with the thickness of 90 μm for partitioning each pressure generating chamber 12, the passage formed substrate 10 with the depth of 220 μm and the backing member 110 provided with the partitioning wall 111 with the thickness and the height of 100 μm are formed using a silicon monocrystalline substrate and an ink droplet is jetted, relative displacement by flexure in the center of the partition 11 for partitioning each pressure generating chamber 12 is 4.3.

In the meantime, when an ink droplet is jetted in a state in which the backing member 110 is not fixed, relative displacement by flexure in the center of the partition 11 for partitioning each pressure generating chamber 12 is 4.7.

Therefore, it is clear that according to the above embodiment in which the backing member 110 is fixed, the quantity of displacement of the partition 11 for partitioning each pressure generating chamber 12 when an ink droplet is jetted is reduced by approximately 10%.

The deformation of the whole recording head caused by difference in thermal expansion between the passage formed substrate and the nozzle plate 18 constituted by different material can be reduced without causing flexure by difference in thermal expansion by constituting the backing member 110 by the same material as that of the passage formed substrate 10, compared with a conventional type of recording head not using the backing member 110.

The ink jet head constituted as described above takes ink from the ink lead-in port 16 connected to external ink supply means not shown, after the ink jet head fills the inside from the reservoir 14 to the nozzle aperture 17 with ink, the ink jet head applies voltage between the lower electrode film 60 and the upper electrode film 80 via the lead electrode 100 according to a recording signal from an external driving circuit not shown, pressure in the pressure generating chamber 12 is increased by flexing the elastic film 50 and the piezoelectric film 70 and an ink droplet is jetted from the nozzle aperture 17.

Second Embodiment

Figure 5A:
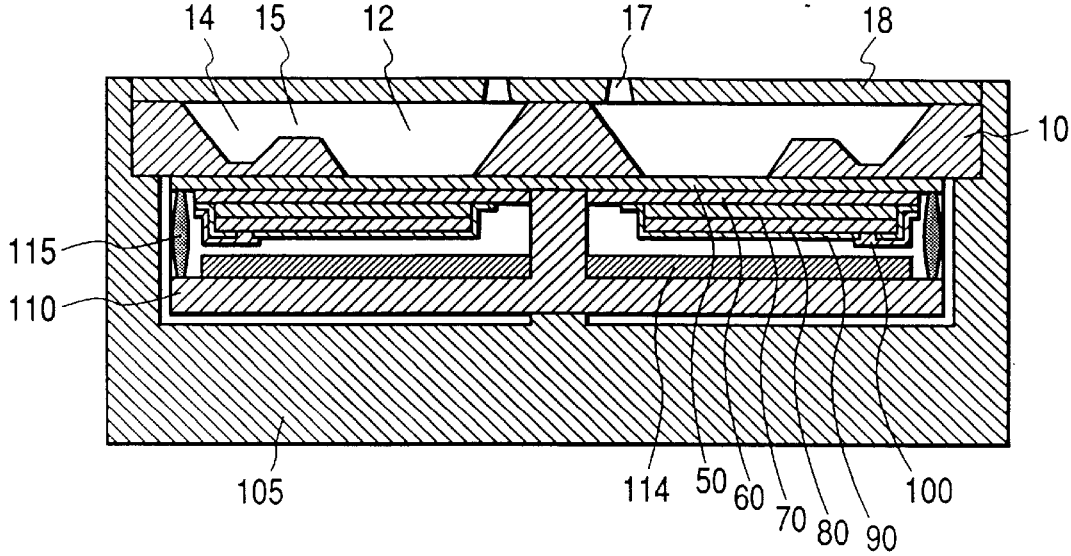
FIGS. 5(*a*) and 5(*b*) respectively show the sectional structure of an ink jet recording head according to a second embodiment of the present invention in the longitudinal direction of a pressure generating chamber and in the direction of the array of pressure generating chambers.
Figure 5B:
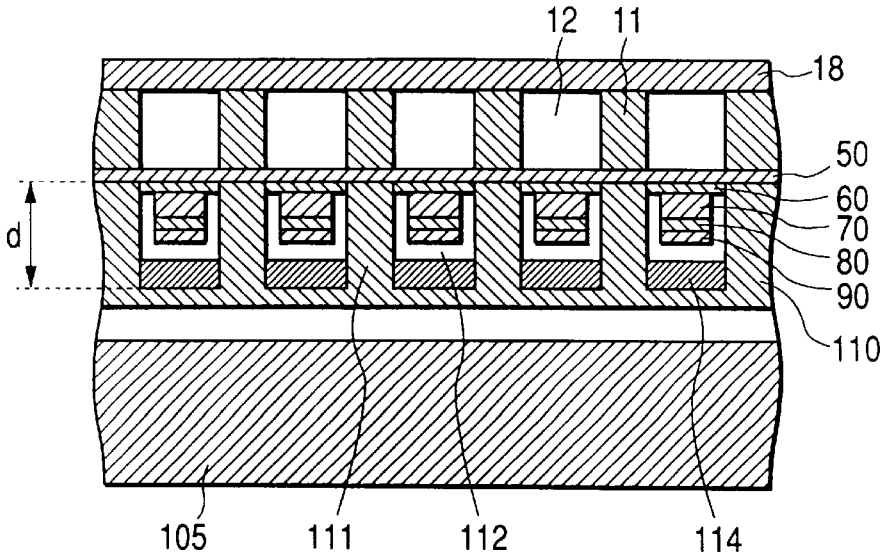

FIGS. 5(*a*) and 5(*b*) respectively show the sectional structure equivalent to a second embodiment in the longitudinal direction and in the direction of the width of a pressure generating chamber.

As shown in FIGS. 5(*a*) and 5(*b*), this embodiment is the same as the first embodiment except that the depth d of each concave portion 112 in the backing member 110 is increased, a porous member 114 in which silicone oil and others hardly including moisture are impregnated is filled inside each concave portion 112 so that the upper electrode film 80 is not touched, dry inert gas is filled and the opening 113 is scaled by an adhesive 115.

According to this embodiment, air in external environment is prevented from invading, the piezoelectric film 70 can be isolated from humidity and the deterioration due to moisture absorption and the deterioration of dielectric strength can be prevented.

Third Embodiment

Figure 6:
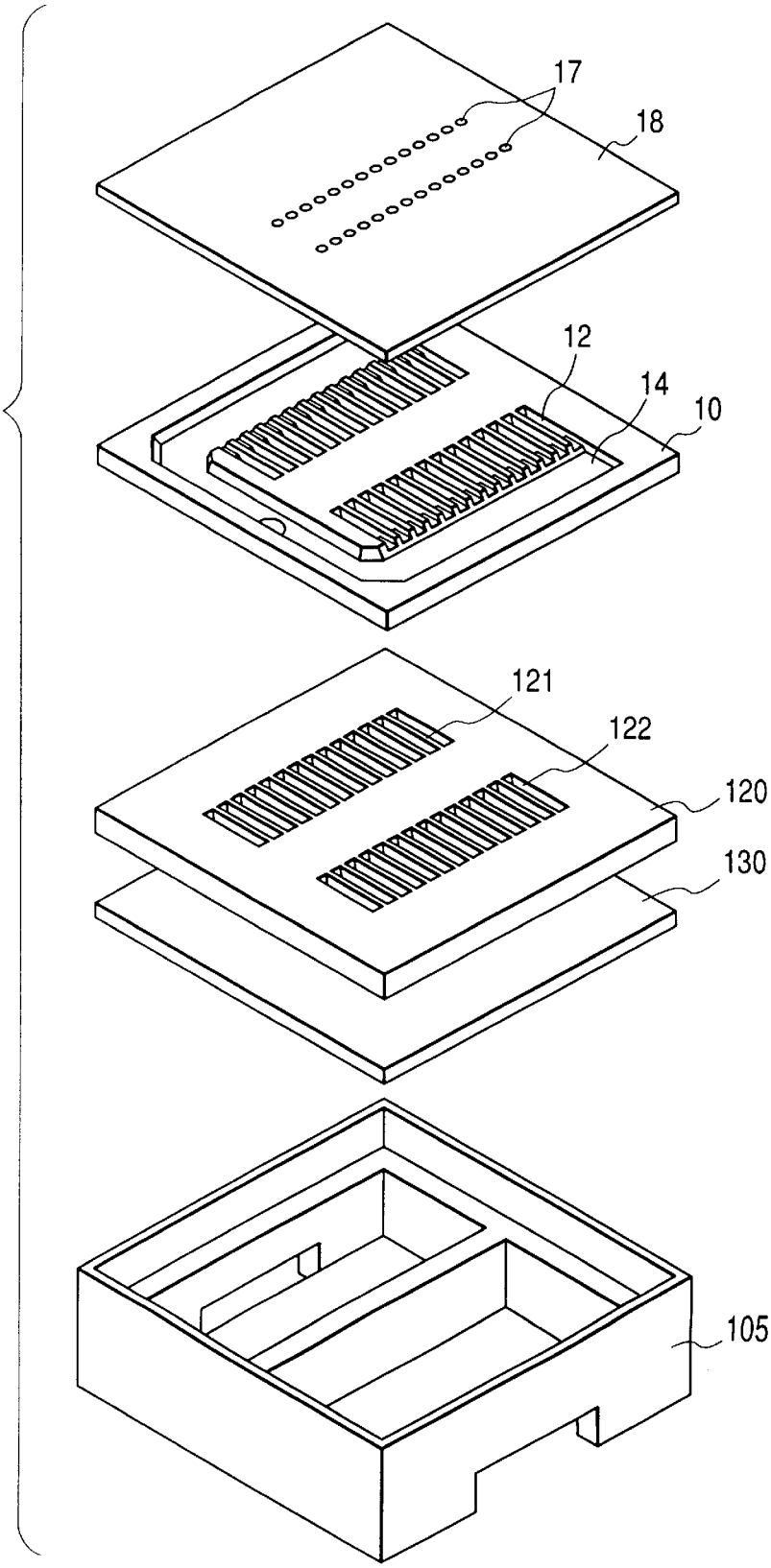
FIG. 6 is an exploded perspective drawing showing an ink jet recording head according to a third embodiment of the present invention.
Figure 7A:
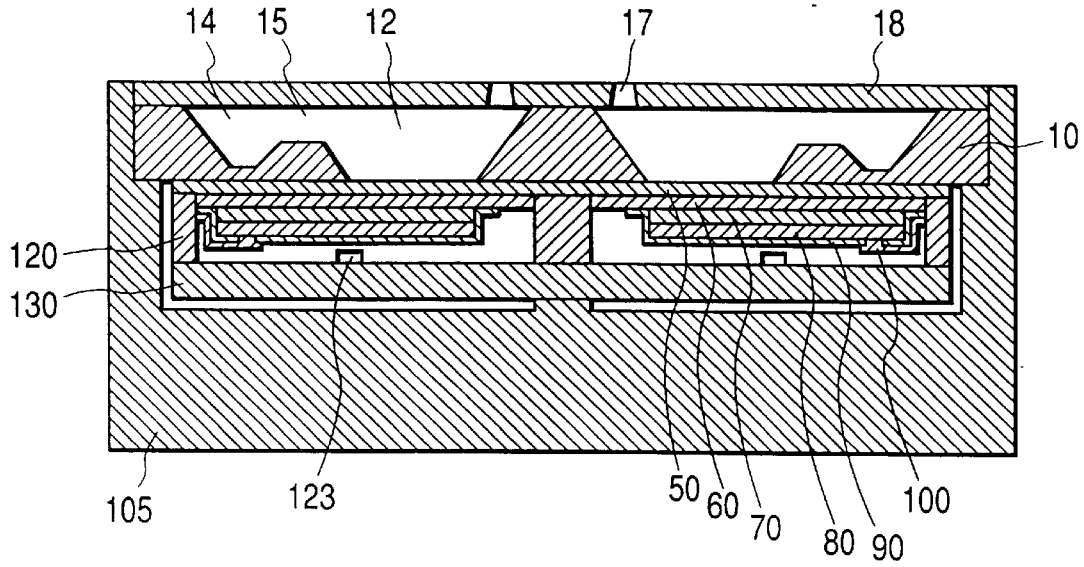
FIGS. 7(*a*) and 7(*b*) respectively show the sectional structure of the ink jet recording head according to the third embodiment of the present invention in the longitudinal direction of a pressure generating chamber and in the direction of the array of pressure generating chambers.
Figure 7B:
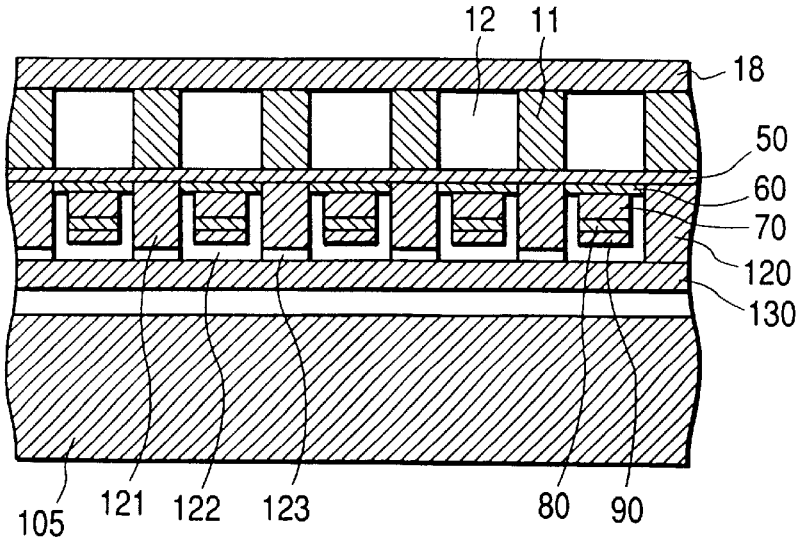

FIG. 6 is an assembly perspective drawing showing an ink jet recording head equivalent to a third embodiment and FIGS. 7(*a*) and 7(*b*) respectively show the sectional structure in the longitudinal direction and in the direction of the width of a pressure generating chamber.

In this embodiment, as shown in FIGS. 6 to 7(*b*), a backing member is constituted by a first backing member 120 and a second backing member 130 fixed to the first backing member 120.

A through groove for forming a concave portion 122 provided with space to the extent that the driving of a piezoelectric active part is not prevented is formed in the area opposite to each pressure generating chamber 12 of the first backing member 120 and the reverse side of each through groove is sealed by the second backing member 130. Each concave portion 122 is partitioned by partitioning walls 121, a communicating part 123 for connecting adjacent concave portions 122 is provided at the end on the reverse side to the passage formed substrate 10 of the partitioning wall 121 and approximately in the center of the longitudinal direction of each pressure generating chamber 12 and hereby, all the concave portions 122 are connected.

The material of such first backing member 120 and second backing member 130 is not particularly limited and a silicon monocrystalline substrate which is the same material as that of the passage formed substrate 10, glass ceramics and others may be used.

The other basic structure is the same as in the above embodiments.

Stress which acts upon a pressure generating chamber is prevented from being propagated to a partition as in the above embodiments by constituting as described above and crosstalk is prevented from being caused. Also, in this embodiment, as a piezoelectric active part is sealed in each concave portion 122 and completely cut off the outside, the failure of operation caused by external environment can be prevented. Further, as each concave portion 122 is connected via each communicating part 123, the variation of pressure in each concave portion 122 can be absorbed one another.

A position in which the communicating part 123 for connecting each concave portion 122 is provided is not limited to that in this embodiment and the communicating part may be provided in any position of the partitioning wall 121. However, as it is desirable that a part in which the partitioning wall 121 is joined to the passage formed substrate 10 is increased as much as possible in view of preventing crosstalk, it is desirable that the communicating part 123 is formed so that it is not opposite to the face opposite to the passage formed substrate 10 of the partitioning wall 121. Also, in this embodiment, to readily form the communicating part 123, the backing member is constituted by two members, however, it is natural that the present invention is not limited to this.

Other Embodiments

The embodiments of the present invention are described above, however, the basic constitution of the ink jet recording head is not limited to the above constitution.

Figure 8:
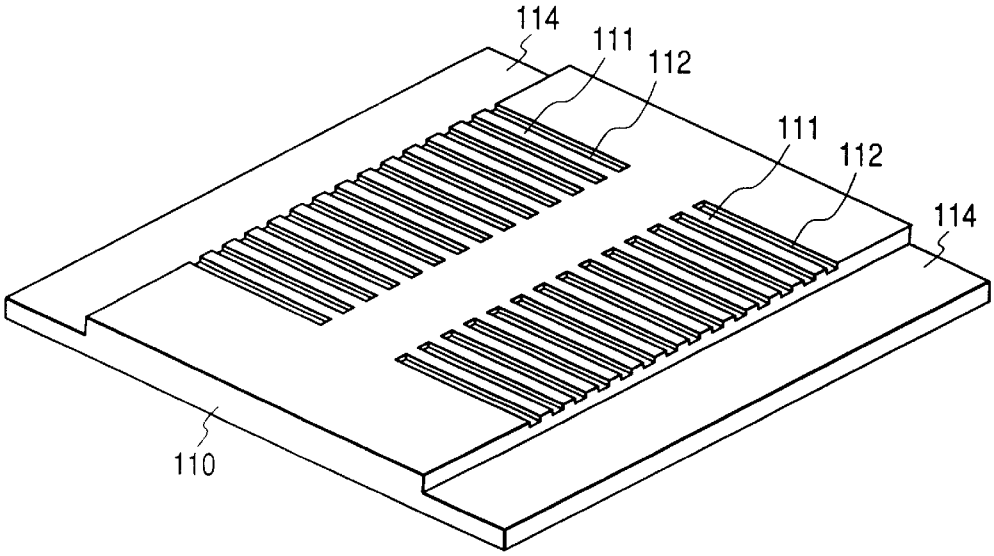
FIG. 8 is a perspective drawing showing a backing member according to another embodiment of the present invention.

For example, the form of the backing member is not limited to that in the above embodiments and as shown in FIG. 8, a part with difference in a level is provided at the end and a fixing part 114 for fixing a cable and others may be also formed.

In the above embodiments, the example that the backing member is constituted by two members and concave portions for respectively covering a piezoelectric active part are formed is shown, however, the present invention is not limited to this and for example, both may be also integrated. It need hardly be said that the backing member may be constituted by three or more members.

Further, in the above embodiments, the reservoir 14 is formed together with the pressure generating chamber 12 in the passage formed substrate 10, however, a member for forming a common ink chamber may be also provided on the top of the passage formed substrate 10.

Figure 9:
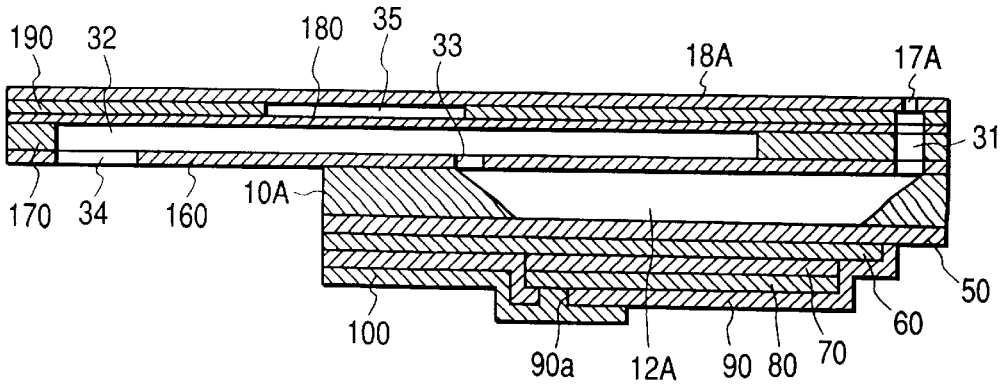
FIG. 9 is a sectional view showing an ink jet recording head according to another embodiment of the present invention.

FIG. 9 shows the partial section of an ink jet recording head constituted as described above. In this embodiment, a sealing plate 160, a common ink chamber forming plate 170, a thin plate 180 and an ink chamber side plate 190 are held between a nozzle substrate 18A in which nozzle apertures 17A are made and a passage formed substrate 10A and a nozzle communicating port 31 for connecting a pressure generating chamber 12A and each nozzle aperture 17A is arranged through these. That is, a common ink chamber 32 is formed by the sealing plate 160, the common ink chamber forming plate 170 and the thin plate 180, and each pressure generating chamber 12A and the common ink chamber 32 are connected via an ink communicating hole 33 made in the sealing plate 160. An ink lead-in hole 34 for leading ink from the outside to the common ink chamber 32 is also made in the sealing plate 160. A through part 35 is formed in a position opposite to each common ink chamber 32 in the irk chamber side plate 196 located between the thin plate 180 and the nozzle substrate 18A, pressure generated when an ink droplet is jetted and directed on the reverse side to the nozzle aperture 17A can be absorbed by the thin wall 180 and hereby, unnecessary positive or negative pressure can be prevented from being applied to another pressure generating chamber via the common ink chamber 32: The thin plate 180 and the ink chamber side plate 190 may be also integrated.

In such an embodiment, the flexure of the passage formed substrate 10A can be also prevented by joining the above backing member in the area opposite to the partition 11 for partitioning each pressure generating chamber 12 and on the reverse side to the open face of the passage formed substrate 10A.

In the above embodiments, a thin film type of ink jet recording head manufactured by applying a film forming and lithographic process is described as an example, however, naturally, the present invention is not limited to this and the present invention can be applied to an ink jet recording head with various structure such as an ink jet recording head in which substrates are laminated and pressure generating chambers are formed, an ink jet recording head in which a piezoelectric film is formed by sticking a green sheet, screen process printing and others and an ink jet recording head in which a piezoelectric film is formed by crystal growth.

Further, in the above embodiments, a connection between an upper electrode film and a lead electrode may be provided in any location, at any end of a pressure generating chamber or in the center.

The example that the insulating layer is provided between the piezoelectric vibrator and the lead electrode is described above, however, the present invention is not limited to this, for example An anisotropic conductive film may also be thermically welded to each upper electrode without providing an insulating layer, the anisotropic conductive film may be also connected to a lead electrode and bonding technique such as wire bonding may be also used for connection.

As described above, the present invention can be applied to an ink jet recording head with various structure to achieve the object.

Figure 10:
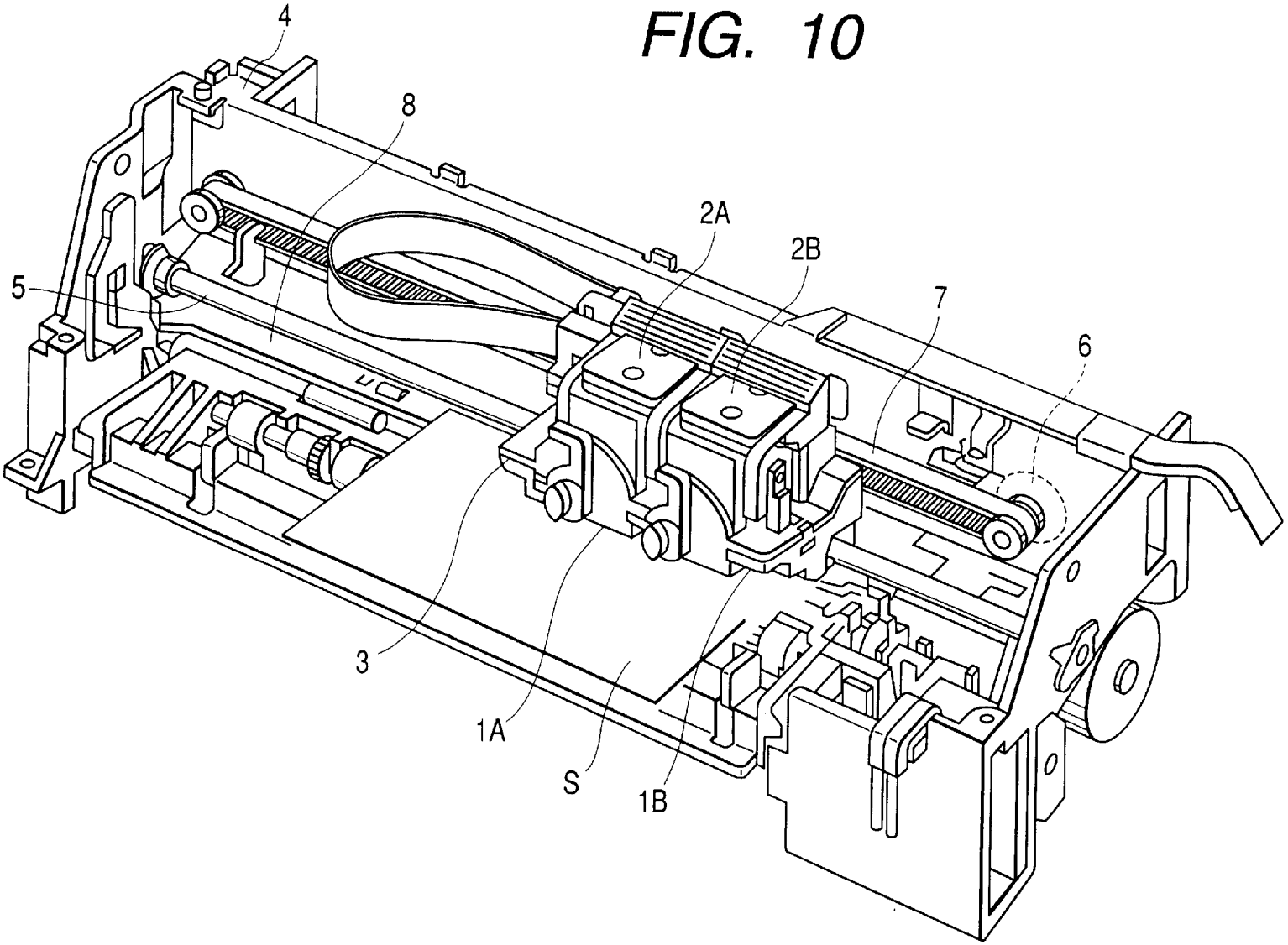
FIG. 10 is showing a schematic representation view of an embodiment of the ink jet recording apparatus to which a present invention is applied.

The ink jet recording head described in the preferred embodiment is constructed of a part of an ink jet recording head unit including an ink flow path communicated with an ink cartridge or the like, and is loaded on an inkjet recording apparatus. FIG. 10 is showing a schematic representation view of an embodiment of the ink jet recording apparatus to which a present invention is applied.

As shown in FIG. 10, head units 1A and 1B include the ink jet recording head, respectively. Cartridges 2A and 2B serving as ink supply means are detachably provided on the head units 1A and 1B, respectively. The head units 1A and 1B are loaded on carriage 3. The carriage, which is moved in the axis direction, is provided on a carrage axis 5 mounted on a main body 4. The head units 1A and 1B expel, for example, a black ink composite and a color ink composite.

Then, a driving force generated by a driving motor 6 is transmitted to the carriage 3 through a plurality of gears (not shown) and a timing belt 7 to move the carriage having the head units 11A and 1B along the carriage axis 5.

On the other hand, on the main body 4, the platen 8 is provided along with the carriage 3. The platen 8 takes up a recording sheet serving as a recording media such as paper supplied by a supply roller to transmit the recording media.

As described above, according to the present invention, as a backing member provided with a partitioning wall for partitioning a concave portion comprising space to the extent that the movement of a piezoelectric film is not prevented is fixed on a passage formed substrate so that the partitioning wall is opposite to the partition of the passage formed substrate, the flexure of the wall of the passage formed substrate can be inhibited by receiving the displacement of a piezoelectric active part when an ink droplet is jetted by the backing member fixed via an elastic film and crosstalk can be prevented. The failure of operation caused by external environment can be prevented. At that time, deformation can be mutually absorbed by providing a communicating part for connecting adjacent concave portions to the partitioning wall of the backing member and the flexure of the passage formed substrate can be inhibited.

What is claimed is:

1. An ink jet recording head comprising:

a passage formed substrate having partitions forming at least a row of pressure generating chambers;

an elastic film forming a part of the pressure generating chambers;

a piezoelectric vibrator formed on said elastic film opposite to said pressure generating chambers; and a backing member joined to the passage formed substrate on a side of the piezoelectric vibrator and having partitioning walls forming concave portions between said partitioning walls, said concave portions being spaced such that a movement of the piezoelectric vibrator is not prevented, and fixed such that each partitioning wall is opposite to a corresponding partition of the passage formed substrate.

2. The ink jet recording head according to claim 1, wherein whole faces of the partitioning walls opposite to the passage formed substrate are joined to the passage formed substrate.

3. The ink jet recording head according to claim 2, wherein the elastic film and a lower electrode of said piezoelectric vibrator are formed in a region where the partitioning walls are joined to the passage formed substrate.

4. The ink jet recording head according to claim 2, wherein only the elastic film is formed in a region where the partitioning walls are joined to the passage formed substrate.

5. The ink jet recording head according to claim 1, wherein the partitioning walls have a communicating part which communicates with adjacent the concave portions.

6. The ink jet recording head according to claim 5, wherein the communicating part is not opposite to the face of the partitioning walls opposite to the passage formed substrate.

7. The ink jet recording head according to claim 5, wherein said backing member comprises more than one member.

8. The ink jet recording head according to claim 1, wherein the width of the concave portion of the backing member is is wider than the width of the pressure generating chamber.

9. The ink jet recording head according to claim 1, wherein dry fluid is sealed in space in the concave portion of the backing member.

10. The ink jet recording head according to claim 1, wherein the passage formed substrate and the backing member are made of the same material.

11. The ink jet recording head according to claim 1, wherein the pressure generating chambers are formed by anisotropically etching a silicon monocrystalline substrate; and each layer of the piezoelectric vibrator is formed by a film forming method and lithography.

12. The ink jet recording head according to claim 1, further comprising:

a reservoir formed in the passage formed substrate, wherein said reservoir communicates with the pressure generating chamber; and a nozzle plate having nozzle apertures, wherein each aperture communicates with a respective pressure generating chamber, and said nozzle plate is attached to the passage formed substrate.

13. The ink jet recording head according to claim 1, further comprising:

a common ink chamber forming plate attached to the passage formed substrate, the common ink chamber forming plate having:

a common ink chamber for supplying ink to the pressure generating chambers; and a passage respectively connecting the pressure generating chambers and to nozzle apertures.

14. The ink jet recording head according to claim 13, further comprising a thin plate which absorbs pressure generated when ink is jetted out of said nozzle apertures.

15. The ink jet recording head according to claim 14, further including a through part positioned adjacent said thin plate.

16. An ink jet recording apparatus comprising:

an ink jet recording head, wherein said ink jet recording head comprises:

a passage formed substrate having partitions forming at least a row of pressure generating chambers;

an elastic film forming a part of the pressure generating chambers;

a piezoelectric vibrator formed on said elastic film opposite to said pressure generating chambers; and a backing member joined to the passage formed substrate on a side of the piezoelectric vibrator and having partitioning walls forming concave portions between said partitioning walls, said concave portions being spaced such that a movement of the piezoelectric vibrator is not prevented, and fixed such that each partitioning wall is opposite to a corresponding partition of the passage formed substrate.

* * * * *